US005197849A

United States Patent [19]

Tübke

[11] Patent Number: 5,197,849

[45] Date of Patent: Mar. 30, 1993

[54] STACK SQUARING DEVICE

[75] Inventor: Axel B. Tübke, Berlin, Fed. Rep. of Germany

[73] Assignee: System GmbH, Düsseldorf, Fed. Rep. of Germany

[21] Appl. No.: 635,193

[22] Filed: Jan. 2, 1991

[30] Foreign Application Priority Data

Jan. 3, 1990 [DE] Fed. Rep. of Germany ..... 4000263

[51] Int. Cl.[5] ..... B65H 31/38

[52] U.S. Cl. ..... 414/788; 414/789.1; 414/790.2; 414/907

[58] Field of Search ..... 414/788, 788.9, 789, 414/789.1, 789.9, 790, 790.1, 790.2, 793.4, 794.4, 794.5, 907; 271/221, 222, 236, 238, 240, 241, 245

[56] References Cited

U.S. PATENT DOCUMENTS

| | | | |
|---|---|---|---|
| 2,275,688 | 3/1942 | Schulz | 271/222 |
| 2,626,147 | 1/1953 | Gjostein | 271/222 X |
| 2,805,757 | 9/1957 | Rapley | 414/788 |
| 3,030,867 | 4/1962 | Wright | 414/789.1 X |
| 3,172,656 | 3/1965 | Mestre | 414/789.1 X |
| 3,308,923 | 3/1967 | Crawford | 198/395 |
| 3,385,457 | 5/1968 | Zinn | 271/222 X |
| 3,563,360 | 2/1971 | Wickersheim | 271/221 X |
| 3,647,092 | 3/1972 | Bulat et al. | 414/788 |
| 3,733,070 | 5/1973 | Obenshain | 271/221 |
| 3,827,582 | 8/1974 | Lederer | 414/789 X |
| 3,842,995 | 10/1974 | Dooley | 414/788 |
| 3,904,045 | 9/1975 | Thibault | 414/788.9 |
| 4,178,118 | 12/1979 | Bailey | 414/788 |
| 4,346,882 | 8/1982 | Pessina et al. | 414/789.1 X |
| 4,484,736 | 11/1984 | Osburg et al. | 271/221 X |
| 4,545,715 | 10/1985 | Seefeldt | 414/789.1 |
| 4,588,070 | 5/1986 | Smith | 414/790.2 X |
| 4,610,593 | 9/1986 | Voss et al. | 414/794.4 X |
| 4,647,265 | 3/1987 | Uno | 414/790.2 |
| 4,674,934 | 6/1987 | Honger | 414/790.2 X |

FOREIGN PATENT DOCUMENTS

| | | | |
|---|---|---|---|
| 1079522 | 2/1957 | Fed. Rep. of Germany | 414/788 |
| 2718193 | 1/1978 | Fed. Rep. of Germany . | |
| 2807295 | 8/1978 | Fed. Rep. of Germany . | |
| 3024112 | 2/1982 | Fed. Rep. of Germany . | |
| 3603484 | 8/1987 | Fed. Rep. of Germany . | |
| 3711584 | 10/1988 | Fed. Rep. of Germany . | |
| 3712104 | 11/1988 | Fed. Rep. of Germany . | |
| 1363173 | 1/1964 | France . | |
| 9705 | of 1900 | United Kingdom | 271/221 |

*Primary Examiner*—F. J. Bartuska
*Assistant Examiner*—Stephen T. Gordon
*Attorney, Agent, or Firm*—Spencer, Frank & Schneider

[57] ABSTRACT

A stack squaring device, particularly for squaring a stack consisting of a plurality of thin sheets, includes a horizontal conveyor to transport the stack in a direction of conveyance from a reception area, via a squaring area into a discharge area. A stack stop extends in a direction perpendicular to the direction of conveyance of the stack, is disposed in the discharge area and is movable in the stack conveyance area. Two contact plates are disposed at the sides of the stack and at least one contact plate constitutes a vibrator plate which is connected to a vibrator drive unit. A bearing plate is provided beneath the stack. A pressing plate is lowered vertically onto the stack, whereby the pressing plate and the bearing plate are guided relative to one another in the direction of a common axis, preferably in the direction of a vertical axis. The dimensions of the pressing plate and the bearing plate are smaller than the cover surface of the stack. A gripper including tines for grabbing a stack is disposed in an engagement area which is at least freely accessible from one side of the squaring device and disposed underneath and above the squared stack. The stack is disposed between the pressing plate and the bearing plate, so that the squared stack can be grabbed without hinderance from a direction perpendicular to the direction of the common axis.

10 Claims, 2 Drawing Sheets

STACK SQUARING DEVICE

BACKGROUND OF THE INVENTION

This invention relates to a stack squaring device, particularly for a stack consisting of a plurality of thin sheets. The stack squaring device includes a horizontal conveyor to transport the stack from a reception area, via a squaring area into a discharge area. A stack stop is disposed in the discharge area and can be swung into the stack conveyance area. Two contact plates are disposed at the sides of the stack when it is in the squaring area and at least one of the contact plates is in the form of a vibrator plate. The vibrator plate is driven by a vibrator drive unit.

Such a stack squaring device for squaring a stack, consisting of a plurality of paper sheets or similar objects, is disclosed in German Published Application 3,712,104. This stack squaring device is connected to a horizontal conveyor system which comprises a plurality of individual longitudinal conveyors and which are placed at a distance to one another. A stack grid is disposed underneath the level at which the stacks are conveyed on the horizontal conveyor system. The stack grid comprises longitudinal bars which are orientated in parallel with the individual longitudinal conveyors. The stack squaring device further comprises a front stack stop which is perpendicular to and can also be displaced above the stack conveying level. The front end of the stack grid can be pivoted about a horizontal transverse axis and the stack grid is mounted in the horizontal conveyor system and can be lifted up over the stack conveying level with the help of a piston aggregate which engages with its back end with the stack bearing area which is formed by the longitudinal bars. Two vibrator plates and a press plate are arranged underneath and one press plate is arranged above the stack grid.

The prior art device has the drawback, that it is of a very complicated and costly construction. A stack can only be squared in an inclined position. Every stack which is to be squared must therefore be pivoted back and forth by the apparatus. Due to these steps, which are necessary due to the construction, the device is prone to breakdowns, particularly if operated continually. Furthermore, the extreme length of the squaring process and the costs that this incurs act detrimentally with regard to the rentability of the prior art device. The device can also only be fed and emptied by the horizontal conveyor, so that the device is very inflexible and is not suitable for other conveyor systems of a different construction.

In addition the squared stack loses its compacted state and its squareness during further transportation on the horizontal conveyor system.

SUMMARY OF THE INVENTION

It is the object of the invention to provide, in a device of the above-mentioned type, a structure which is of a simplified configuration and with which the above-mentioned drawbacks are eliminated so that the device can be coupled with other conveyer means and/or processing devices and with which the stack retains its squared shape. In particular, the time required for the squaring process in conjunction with the transport procedures is to be reduced.

This object and others to become apparent as the specification progresses, are accomplished by the invention, according to which, briefly stated, the stack squaring device comprises a horizontal conveyor; a stack stop; two contact plates which are disposed at the sides of the stack and of which at least one is in the form of a vibrator plate driven by a vibrator drive unit; a bearing area for the stack; a pressing means which can be lowered vertically onto the stack, whereby the pressing means and the bearing area are guided relative to one another in the direction of a vertical axis and an engagement area for a gripping device comprising tines, whereby the engagement area is at least freely accessible from one side and is disposed underneath and above the squared stack, which itself is disposed between the pressing means and the bearing area, so that the squared stack can be grabbed without hinderance from a direction perpendicular to the direction of the vertical axis.

The invention is based on the realization that the required quality of stack squareness can be achieved with the stack squaring device by squaring the stack on a level surface. Due to this, the speed of the squaring process is increased substantially and measures, such as those related with a pressing means and engagement areas for a gripping device, can be taken which are advantageous for the squaring procedure.

Very important for the resulting reduction in processing and transportation time is not only that the squaring area is situated in the stack conveyance area and that the squaring of the stack takes place essentially in this area, but also that the engagement area for the gripping device is freely accessible so as to be able to guarantee rapid and suitable further transportation. The linkage between the movements of the pressing means which hold the stack after squaring and the bearing area and the movements of the gripping device is crucial in order for the squareness of the stack to be retained. The stack is held after squaring by the pressing means which can be lowered onto the stack during the squaring process and by the bearing area which presses upwards from underneath under the force of a load which presses the individual sheets of the stack together. At that moment when the gripping device engages the stack the pressing means disengages itself from the stack. The stack is then pressed together by the gripping device and can be easily moved together with the gripping device. Individual thin sheets of the stack are thus prevented from becoming disarranged due to the essentially continual compaction of the stack after squaring. The squared shape of the stack can therefore be retained in an advantageous manner even during transportation.

A particular advantage is that the stack squaring device comprises a bearing area for the stack and a pressing means which can be lowered vertically onto the stack from above. The pressing means and the bearing area are facing each other. It is also advantageous if one engagement area for the gripping device, which is freely accessible from at least one side is situated above and underneath the squared stack between the pressing means and the bearing area. The stack can then be easily grabbed by the gripping device.

Thus, after squaring, the stack at first bears a load which compresses the stack due to the pressing means and the bearing area and then bears a load due to the tines of the gripping device which compress the stack. The pressure on the stack remains during the transportation process so that no air, which could destabilize the stack, can enter in between the individual thin sheets. The gripping device is therefore much more suitable as a transportation means than the horizontal conveyor means. This is why, in particular, the discharge of a squared stack is very advantageous if carried out by a gripping device.

In particular, the following advantageous modifications are favorable:

Recesses in the conveying level of the stack form the engagement areas for the gripping device underneath the stack so that the gripping device can be guided under the stack. The stack can therefore be grabbed by the gripping device in a manner which is not time-consuming and is advantageous for further transportation after it has been guided to the stack in the recess in a direction opposite to the direction of conveyance. The lower tines of the gripping device are situated totally under the stack during the grab process. An optimated grabbing action and a load which optimally holds the squared stack is guaranteed. Furthermore, the recesses in the stack conveying level extend essentially in a horizontal direction opposite to the direction of conveyance.

It is additionally advantageous that the pressing means are formed as a press plate which can be placed from above onto the stack which is positioned in the squaring area. The press plate presses out the air which is in between the pages or sheets in an advantageous manner, so that the stack is in an advantageous stable, compact and compressed condition after squaring. In this way it is relatively unlikely that the sheets which make up a stack are displaced relative to one another.

In a further variation during squaring, the squaring area and the discharge area and therefore also the position in which the stack is grabbed by the gripping device are all the same area. In this way the stack is grabbed directly and without time-loss.

In accordance with another advantageous embodiment, the bearing area for the stack is formed by a piston plate with a piston drive unit in the squaring area. The piston plate is disposed in the squaring area underneath the stack conveying level of the horizontal conveyors. The piston device, comprising the piston plate and the piston drive unit is defined by a stroke length which is greater than the height of the squaring area. The press plate is therefore also constructed accordingly, so that it can be displaced by a stroke length in an upward direction together with the piston plate.

A height difference can therefore be compensated for easily, in an advantageous manner without the loads which act to stabilize the stack and which act on the stack having to be taken away. The stack can therefore be squared, compressed and grabbed by the gripping device at a height which is advantageous for the further process. A height adjustment proves to be advantageous for the total design concept for squaring, transportation and further processing plants for the process and leads to a reduction of time required for the process, in particular with regard to possible concurrent work stages.

In order to be able to square the stack better and more quickly, an additional contact plate is situated on the side of the stack which is furthest away from the stack stop. The additional contact plate is pivotable in towards the stack conveyance area about a rotational axis which runs parallel to the direction of conveyance. In addition, the additional contact plate has a vibrator drive unit and also acts as a vibrator plate for the squaring process. In this way it is possible that the stacks can be transported without any hinderances by the horizontal conveyor in the squaring area and that the stacks are confined on all sides during squaring and can be agitated from three sides.

Preferably the side contact plates are pivotable about a vertically directed axis. The stack thereby obtains sufficient space for further movements and transport processes. In addition, the contact plates can be adapted to correspond with differing stack widths.

The conveyor comprises air jets which are disposed on the stack conveying level in the squaring region in order to lift the stack, whereby the underside of the stack or the undermost sheet are prevented from being damaged.

It is also particularly advantageous that a separation device for the continuously incoming stacks is disposed in front of the reception area, in order that a jamming up of the squaring area with stacks can be prevented from occuring.

DESCRIPTION OF THE PREFERRED EMBODIMENT

Figure 1:
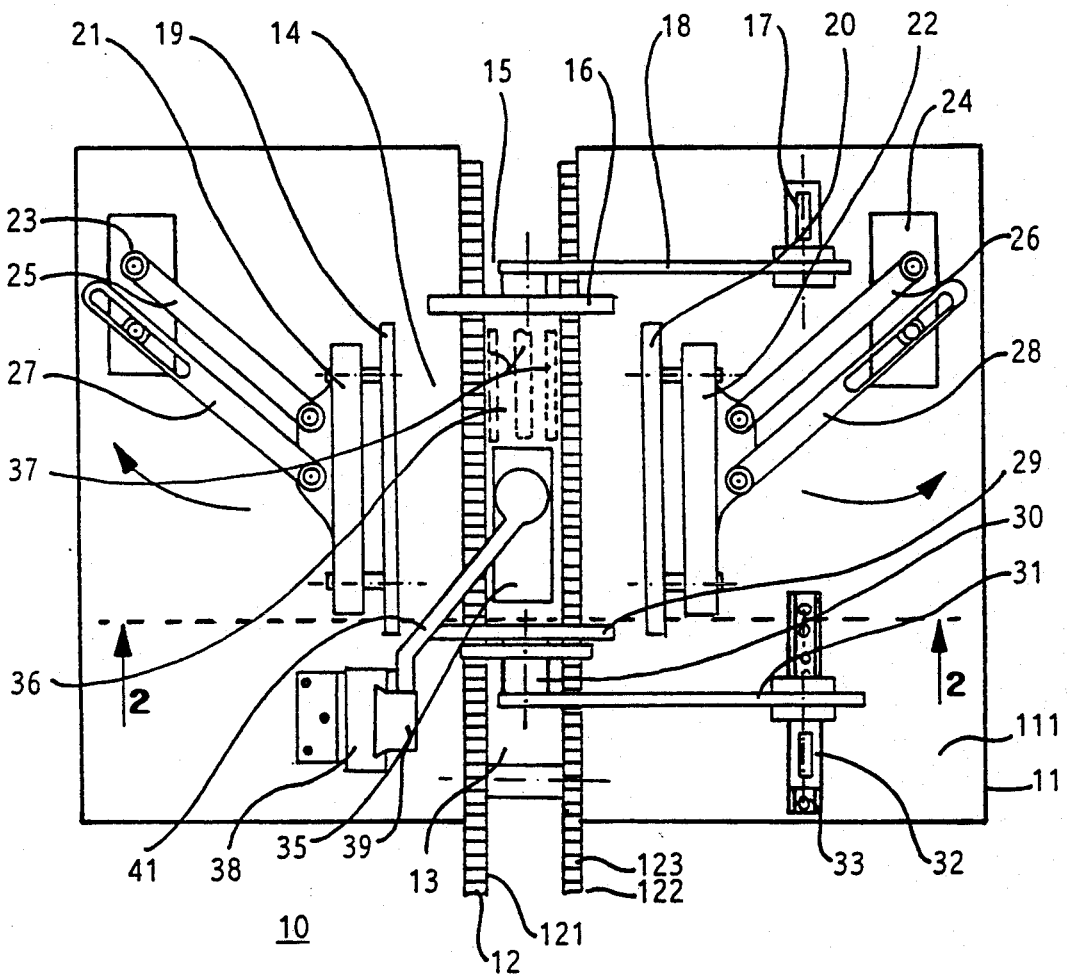
FIG. 1 is a top plan view of a preferred embodiment of the invention.
Figure 2:
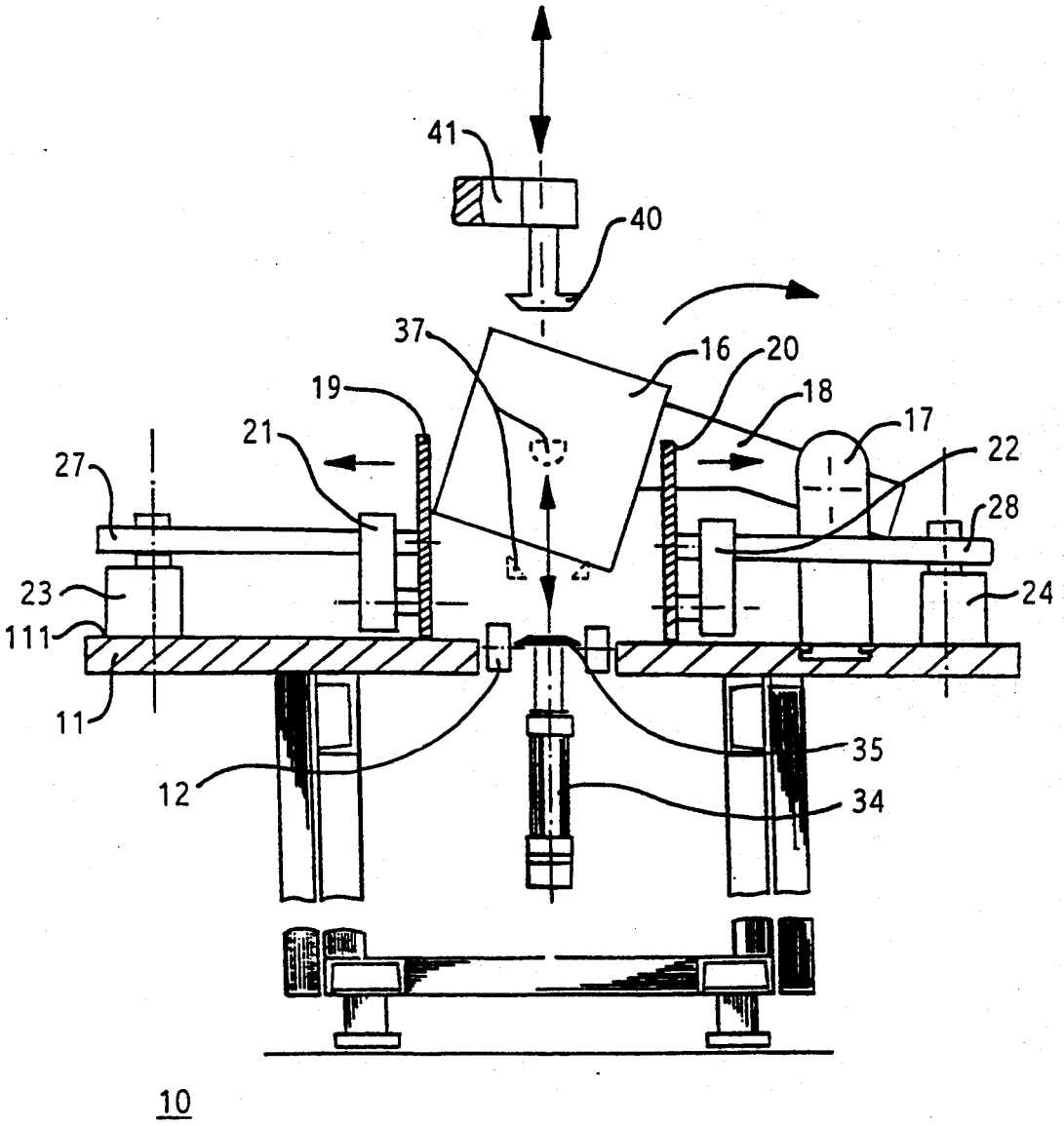
FIG. 2 is a cross-sectional view taken on line A—A of the embodiment of the invention of FIG. 1.

A top plan view of a preferred embodiment of a stack squaring device, particularly to square a stack which comprises a plurality of sheets, is shown in FIG. 1 and FIG. 2 shows a cross-sectional view of the same preferred embodiment as shown in FIG. 1 taken on line A—A. The following description is based on these two figures.

The stack squaring device 10 to square a stack S, which is not visible in the figures, comprises the following elements and characteristics:

A work plate 11 of the stack squaring device 10 comprises a horizontal conveyor 12 to transport the stack from a reception area 13 into a squaring area 14 and to a discharge area 15. The horizontal conveyor 12 runs essentially parallel to the upwardly facing work surface 111 of the work plate 11 and comprises two individual longitudinal conveyors 121 and 122, which run parallel to each other. The contact area 123 of the horizontal conveyor 12 is situated just above the work area 111, so that the stack lying on the horizontal conveyor 12 does not scrape over the work plate 11 when it is transported via the reception area 13 into the squaring area 14 of the stack squaring device 10.

A stack stop 16 is disposed in the discharge area 15 of the horizontal conveyor 12 of the stack squaring device 10. The stack stop 16 runs perpendicular to the direction of conveyance of the stack S and can be moved into the stack conveyance area. The stack stop 16 is pivotable about a rotation axis which runs parallel to the direction of conveyance of the horizontal conveyor 12 and is connected to a drive means 17 via a pivot arm 18. The stack stop 16 can therefore be easily swung into the stack conveyance area by the drive means 17.

Two contact plates 19 and 20 are situated at the sides of the squaring area 14 of the stack and both are formed as vibrator plates. Each contact plate 19 and 20 for the stack has a vibrator drive unit 21 and 22. The contact plates 19 and 20 are each pivotable about a vertical axis and are connected to a swivel drive unit 23 or 24 via a pivot arm 25 or 26 and a parallel guide 27 or 28. In relation to the center axis of both longitudinal conveyors 121 and 122, the swivel-mounted contact plates 19 and 20 are mirror-symmetrically disposed on the work plate 11.

The contact plates 19 and 20 are both, at the same time, swung into the side faces of the stack S to square the sides. During this process the contact plates 19 and 20 always remain parallel to the side faces. After the squaring process the contact faces 19 and 20 again disengage from the side faces of the stack. The stack is in this way freed in order for it to be taken from the squaring area 14. In addition, the contact plates 19 and 20 can, due to their structure and arrangement, be easily adapted to correspond with different stack widths. The contact plates 19 and 20 are, to this end, merely moved in accordance with the stack width.

An additional contact plate 29 is arranged in the reception area 13. This is also constructed as a vibrator plate with a vibration drive unit 30, a pivot arm 31 and an additional drive unit 32 which is similar to a stack stop 16. The contact plate 29 is pivotably mounted on an axis which runs essentially parallel to the direction of conveyance and can therefore be swung into the stack conveyance area as can the stack stop. A track 33, which runs parallel to the direction of conveyance and which is connected with the additional drive unit 32, makes it possible to displace the element comprising the additional drive unit 32, the pivot arm 31, the vibration drive unit 30 and the additional contact plate 29. In order not to limit the pivot area of the pivotable contact plate 20, which is disposed adjacent to this additional contact plate 29, the track 33 is sunk into the work plate 11 and does not protrude out over the base of the work plate 11.

A piston means, which acts in a vertical upward direction and which comprises a pneumatic piston drive 34 and a piston plate 35, is disposed in the squaring area 14, underneath the bearing area 123 of the horizontal conveyor 12, between the individual longitudinal conveyors 121 and 122. The piston plate 35 is not as wide as the distance between the two individual conveyors 121 and 122, so that the piston plate 35 is freely movable in a vertical direction between the individual conveyors 121 and 122.

In front of the side of the piston plate 35 which is nearest to the stack stop 16 is a recess which forms an engagement area 36 for the gripping device which comprises tines 37. The sides of the engagement area 36 are bordered by the individual conveyors 121 and 122 of the horizontal conveyor 12.

The dimensions of the engagement area 36 in the direction of conveyance between the stack stop 16 and the piston plate 35 correspond with the length of the tines 37 of the gripping device. The tines 37 are illustrated with a dashed line and the recess which forms the engagement area 36 runs from the piston plate 35 to the edge area of the working plate 11 in the direction of conveyance. The gripping device can thus, after the stack stop 16 has been swung away, be guided into the engagement area 36 and can grab the stack.

An upwardly running guidance rail 38 is disposed on the work plate 11 beside the reception area 13. A press plate 40 which can be displaced in a vertical direction is mounted on the guidance rail 38 via a lever arm 41 and an additional drive unit 39. The press plate 40 is aligned with the vertical displacement axis of the piston plate 35. The additional drive unit 39 and the piston drive unit 34 are designed so that they can, with coordinated movements, be displaced upwardly whilst gripping the stack.

A distinguishing feature of the stack squaring device 10 is that there are numerous possible ways in which the squared stack can be transported out of the squaring area 14. The stack squaring device 10 is therefore, with regard to the machines following on after the stack squaring device 10, such as automatic palletizing devices or other devices, of the necessary adaptability which is required due to these various devices with regard to the process heights or engagement areas and is therefore of a great flexibility.

When the stack is squared, it is at first transported by the horizontal conveyor 12 via the reception area 13 into the squaring area 14 up until the stack touches the stack stop 16. The horizontal conveyor 12 is then switched off by a sensor, which cannot be seen in the illustration, but which is mounted on the stack stop 16. The side contact plates 19 and 20 and the additional contact plate 29 are swung in towards the stack. By vibrating the contact plates 19, 20 and 29 and by holding the stack stop 16 and due to the pressure of the press plate 40 which has been lowered onto the stack, the stack is squared and is compressed into a stable condition. By then swinging the side contact plates 19 and 20 away from the stack it is then free to be moved due to the freely accessible sides of the stack.

The stack is then discharged and transported in various optimated processes in accordance with the use of the stack.

The stack stop 16 and the additional contact plate 29 are swung back. The press plate 40 is displaced in an upward direction so that the stack is then again transported in the direction of conveyance by the horizontal conveyor 12 and/or its end face is grabbed by the gripping device for further transportation. The conveyance height of the stack 14 which is moved along the horizontal conveyor 12 in this manner is advantageous for the further processing. A height adjustment is no longer necessary.

In another process the stack is taken out of the squaring area 14 by the gripping device after the stack stop 16 has been swung back and after the press plate 40 has been removed at the same time. The additional contact plate 29 acts as a stack stop for the loads which act in a direction opposite to the direction of conveyance of the horizontal conveyor. During the gripping process, the gripping device is guided in the recess in front of the piston plate 35 which forms the engagement area 36 so that the gripping device can grab and transport the stack.

The stack can also be grabbed by the gripping device above the square area 14 if a height adjustment is advantageous for further handling. For this, the stack is displaced vertically up over the squaring area 14 due to a coordinated movement of the piston plate 35 and the press plate 40. The gripping device now moves in towards the stack in a direction opposite to the direction of conveyance until the stack contacts a contact means of the gripping device. The tines 37 are totally underneath or above the stack and grab the stack when the pressure plate 40 is released. The stack stop 16 does not need to be moved with this variation, but instead the further contact plate 29 is swung out of the stack conveyance area in order for the next stack to be received. A necessary height adjustment for the displacement of a stack or for the next machine or the next automatic palletizing device can be easily and quickly carried out by the piston movement of the piston plate 35 and the press plate 40 of this advantageous embodiment of the stack squaring device.

In another embodiment of the invention the work plate 11 comprises air jets for lifting the stack. The air jets are positioned just above the contact area 123 of the horizontal conveyor 12. The lifting of the stack is carried out by the piston plate 35 as shown in the illustrations in order to prevent the undermost sheet of the stack being damaged due to the profiled surface 123 of the horizontal conveyor 12.

A separation device (not illustrated) for the continually incoming stacks is disposed in front of the reception area 13 in order to prevent the stacks from jamming up the squaring area 14. The separation device is controlled by being coupled to the procedure steps of the the squaring device 10 and the horizontal conveyor. In this way, in an advantageous manner, a continuous feeding of the stack squaring device 10 with stacks can be achieved.

It will be understood that the above description of the present invention is susceptible to various modifications, changes and adaptations, and the same are intended to be comprehended within the meaning and range of equivalents of the appended claims.

What is claimed is:

1. A stack squaring device for squaring a stack consisting of a plurality of thin sheets, comprising:

a horizontal conveyor to transport a stack along a conveyance path in a direction from a reception area, via a squaring area into a discharge area;

a stack stop extending in a direction perpendicular to the direction of conveyance of a stack, disposed in said discharge area and movable into the conveyance path;

two side contact plates disposed opposite one another on respective sides of the conveyance path for engagement with sides of a stack, at least one of said side contact plates constituting a vibrator plate;

a vibrator drive unit connected to said one vibrator plate;

bearing means, including a piston plate for supporting a stack from beneath and a piston drive unit coupled to said piston plate, for displacing said piston plate vertically in an upwards direction;

pressing means, including a press plate and a guide unit coupled to said press plate, for guiding said press plate in a vertical direction for lowering said press plate onto a stack positioned in the squaring area, said press plate and said piston palte being guided relative t one another along parallel axes, said press plate and said piston plate having dimensions that are smaller than a respective surface area of a stack to be conveyed, said bearing means and said pressing means cooperating to adjust a squared stack to a desired height; and gripping means comprising tines disposed for grabbing a squared stack, said gripping means being received in an engagement area which allows free access from one side of a squared stack so that the tines of said gripping means can engage a squared stack disposed between said press plate and said piston plate at the desired height and from underneath and above the squared stack without hinderance in a horizontal direction.

2. A stack squaring device as defined in claim 1, wherein said horizontal conveyor has recesses disposed for receiving the tines of said gripping means underneath a squared stack.

3. A stack squaring device as defined in claim 2, wherein said recesses extend essentially in a direction horizontal to said direction of conveyance, so that said gripping means can grab a squared stack in said squaring area from a direction which is opposite to said direction of conveyance.

4. A stack squaring device as defined in claim 1, wherein said squaring area has a height and said piston plate and said piston drive unit are displaceable through a stroke length which is greater than the height of said squaring area.

5. A stack squaring device as claimed in claim 1, wherein said piston drive unit has a given stroke length and said press plate is movable in an upward direction together with said piston plate by a distance equivalent to the stroke length of said piston drive unit for vertically raising a stack.

6. A stack squaring device as defined in claim 1, wherein the tines of said gripping means extend into said squaring area for grabbing a squared stack.

7. A stack squaring device as defined in claim 1, further comprising an additional contact plate disposed opposite said stack stop and movable into the conveyance path so that a stack can be squared between said stack stop and said additional contact plate.

8. A stack squaring device as defined in claim 7, wherein said additional contact plate can be pivoted about a pivot axis which runs parallel to said direction of conveyance.

9. A stack squaring device as defined in claim 8, wherein said additional contact plate comprises a vibration plate and a vibration drive unit, said vibration drive unit being movable together with said additional contact plate.

10. A stack squaring device as defined in claim 1, further comprising means for pivoting said contact plates about a vertical axis.

* * * * *